United States Patent [19]

Moser

[11] Patent Number: 4,540,267

[45] Date of Patent: Sep. 10, 1985

[54] ROLL-FUSING APPARATUS

[75] Inventor: Hermann Moser, Darmstadt, Fed. Rep. of Germany

[73] Assignee: Hoechst Aktiengesellschaft, Frankfurt am Main, Fed. Rep. of Germany

[21] Appl. No.: 622,485

[22] Filed: Jun. 20, 1984

[30] Foreign Application Priority Data

Jun. 27, 1983 [DE] Fed. Rep. of Germany ..... 3323068

[51] Int. Cl.[3] ..... G03G 15/00; B30B 3/04

[52] U.S. Cl. ..... 355/3 FU; 355/14 FU; 219/216; 432/60

[58] Field of Search ..... 355/3 FU, 14 FU, 3 R; 219/216; 432/60

[56] References Cited

U.S. PATENT DOCUMENTS

| | | | |
|---|---|---|---|
| 3,999,038 | 12/1976 | Sikes et al. | 432/60 |
| 4,042,804 | 8/1977 | Moser | 219/216 |
| 4,050,886 | 9/1977 | Moser | 432/60 |
| 4,200,389 | 4/1980 | Matsui et al. | 355/3 FU |
| 4,232,959 | 11/1980 | Ateya et al. | 355/3 FU |
| 4,269,594 | 5/1981 | Umans et al. | 355/3 FU X |
| 4,348,579 | 9/1982 | Namba | 355/3 FU X |
| 4,356,764 | 11/1982 | Haugen | 100/169 |

FOREIGN PATENT DOCUMENTS 0017092 3/1980 European Pat. Off. .

OTHER PUBLICATIONS

IBM Technical Disclosure Bulletin, vol. 16, No. 3, Aug. 1973; Fathergill et al.

European Search Report, RS 67519 DE, 5-8-83.

European Search Report, EP 84 10 6947, 1-08-84.

*Primary Examiner*—A. C. Prescott

*Attorney, Agent, or Firm*—Schwartz, Jeffery, Schwaab, Mack, Blumenthal & Evans

[57] ABSTRACT

Disclosed is a roll-fusing apparatus comprising an internally heated fusing roller and a pressure roller including a coated roller core which has a cylindrical inner surface and an outer surface which is extended to give a saw-toothed or scalloped, repeatedly bent configuration. The coating of the roller core comprises a silicone elastomer which has a cylindrical outer configuration, and the inside of the coating is firmly bonded to the shaped outer surface of the roller core, such that the thickness of the coating varies over the length of the roller. In the roller gap of the roll-fusing apparatus, a passage speed profile is generated which shows a minimum in each of the two external zones of the pressure roller and in the middle of the roller and the maxima of which are located in the boundary surfaces between the central zone and the left-hand and right-hand external zones.

18 Claims, 3 Drawing Figures

ROLL-FUSING APPARATUS

BACKGROUND OF THE INVENTION

The present invention relates to a roll-fusing apparatus which comprises a pair of rollers including a pressure roller and an internally heated fusing roller for fusing a toner image on a copy support, in which the pressure roller has a coated hollow roller core which is supported on a shaft.

In the fusing apparatuses of the prior art, either a roller is used in which the end portions are tapered in the outward direction and which is deformed under the action of contact pressure exerted by another roller, or contact pressure between fusing roller and pressure roller is varied according to the temperature measured in each case. The tapered roller of the former device is provided in order to obtain a favorable pressure profile over the length of the roller and thus prevent wrinkling while the latter device seeks to achieve a uniform quality of fusion by adjusting the contact pressure in a manner such that a predetermined relationship between pressure and temperature is maintained.

European Pat. No. 17,092 discloses a roll fuser of this type, which is provided with a pair of rotatable rollers, one of which has end portions which are tapered in the direction of the outer ends. The roller comprises an outer shell which is centrally supported on a shaft. The main parts of the inner surface of the shell are provided with stepped portions of increasing diameters at each tapered end of the shell. In the tapered end portions of the shell, plugs are mounted on parts of the shaft, which are axially displaceable by means of screw threads. The main body of each plug has a diameter which is smaller than the portion of the internal surface of the shell. The plugs are rotatable on the shaft and can be moved from a retracted position, in which a clearance exists between the plugs and the shell of the roller, into an engaged position, in which end flanges of the plugs engage with the stepped portions of the shell. In the retracted position of the plugs, the end portions of the shell are not mechanically supported by the flanges of the plugs and, as a consequence, the pressure exerted by the back-up roller forces the tapered end portions of the shell against the plugs. The amount of taper and the size of the gap between the plugs and the shell are coordinated in such a way that the behavior of the roller under the action of contact pressure corresponds to that of a substantially cylindrical roller, i.e. a roller which is not tapered.

The tapered configuration of the roller is maintained, on the other hand, when the end plugs are screwed inwardly in the axial direction. Even under pressure exerted by the back-up roller, a concave area of contact results. In this condition, wrinkling of the copy paper in a high-humidity state is precluded.

When the end plugs are screwed outwardly in the axial direction, the roller operates in the manner of a substantially cylindrical roller which does not have a taper. As a result of the contact pressure which is exerted by the back-up roller, the tapered configuration of the roller is flattened. The application of the roller under this condition prevents the so-called "smearing effect" on the copy, which occurs in a dry state, i.e., at very low humidity. The position of the plugs can be manually adjusted when the two rollers are out of contact, or it can be adjusted by means of a motor which is under control of a humidistat.

By supporting the tapered external zones, a higher circumferential speed is produced close to the edges of the roller, and a copy paper which passes through the gap between the two rollers is conveyed at a higher speed along its edges, compared to the speed in the middle. As a result of this, the copy paper is stretched and does not form wrinkles, even at higher humidity. Under very dry conditions, the higher speed in the external zones causes the copy paper to form a buckle in the middle. The toner image, which is to be fused, contacts the fusing roller shortly before it enters into the fusing apparatus. This premature contact may cause smearing of the toner image.

U.S. Pat. No. 4,232,959 discloses a toner image fusing apparatus including a heated roller and a pressure roller, in which a temperature sensor measures the surface temperature of the heated roller. The magnitude of contact pressure exerted by the pressure roller on the heated roller is then varied as a function of the measured surface temperature. The invention seeks to achieve a uniform quality of fusion of the toner image on a copy sheet which is passed between the two rollers, since the process of fusing is influenced both by means of temperature and also by means of contact pressure between the two rollers. Thus, an adjustment is effected such that, for example, contact pressure is reduced when surface temperature rises, and contact pressure is increased when surface temperature drops. In the process, the interrelation between these two variables is controlled on the basis of a predetermined relationship between surface temperature and contact pressure.

SUMMARY OF THE INVENTION

It is an object of the present invention to equalize the characteristic of contact pressure exerted by the pressure roller on the fusing roller in a fusing apparatus of the above-described type, such that the formation of wrinkles or buckles is prevented in copies of DIN A4 through DIN A1 sizes.

It is another object of the present invention to provide a fusing apparatus as above which may readily process different copy materials such as opaque papers, transparent papers or films, without wrinkling or buckling, even though they show different behaviors in their passage through the fusing apparatus.

Still another object of the present invention is to provide a fusing apparatus as above wherein large size copies may be produced without the occurrence of a so-called "smearing effect" or double printing.

In accomplishing the foregoing objects, there has been provided in accordance with the present invention a roll-fusing apparatus comprising a pressure roller and an internally heated fusing roller disposed substantially parallel to each other so that a gap is formed therebetween, for fusing a toner image on a copy support, wherein the pressure roller comprises a coated hollow roller core supported on a shaft, and the roller core comprises a substantially cylindrical inner surface and a radially symmetrical outer surface comprising alternating regions of greater and lesser circumferences. The roller core may comprise three longitudinally oriented zones, such that a middle zone is axially symmetrical about the midpoint of the roller, one end of each external zone borders the middle zone at a relative maximum diameter of the roller core, and the other ends of the external zones are defined by the end faces of the roller. The roller core is coated with a silicone elastomer which conforms on its inner surface to the shape of the roller and has a substantially cylindrical outer configuration. Finally, a film tubing having a substantially uniform thickness is shrunk onto the outside of the coating layer.

Further objects, features and advantages of the present invention will become apparent from the detailed description of preferred embodiments which follows, when considered together with the attached figures of drawing.

DETAILED DESCRIPTION OF PREFERRED EMBODIMENTS

Figure 1:
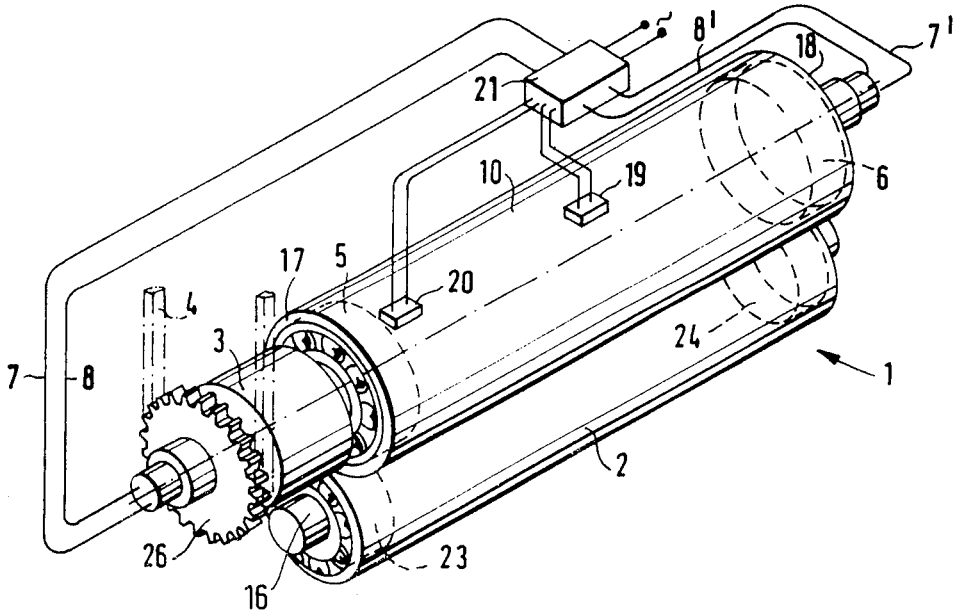
FIG. 1 is a diagrammatic, perspective view of a fusing apparatus which is equipped with a pressure roller according to the present invention.

The present invention provides a roll fusing apparatus wherein the roller core is shaped to form a tube comprising a cylindrical inner surface and a radially symmetrical outer surface comprising alternating regions of greater and lesser circumference, e.g., a sawtooth like or scalloped configuration.

According to one embodiment of the nvention, the roller core is divided into at least three zones over the length of roller, these zones being symmetrically arranged with respect to the middle of the roller. The outside diameter of the roller core in the middle of the roller then corresponds to the outside diameters of the end faces of the roller core, and the maximum outside diameters of the core, which are located between the middle of the roller and the end faces, are up to 2 mm greater than the outside diameter of the core in the middle of the roller. Under particular conditions of temperature and contact pressure in the fusing apparatus, the end faces of the roller core can also have outside diameters which are different from the outside diameter of the core in the middle of the roller.

According to another embodiment of the present invention, a coating of the roller core has a cylindrical outer configuration and is firmly, i.e., without interspace, bonded to the outside of the roller core. The coating of the pressure roller optimally comprises a silicone elastomer, and a film tubing having a constant thickness is shrunk onto the coating. Due to the configuration of the pressure roller, a processing speed is generated in the roller gap over the length of roller, which shows a minimum speed in the two external zones and in the middle of the roller, and a maximum speed located between the left-hand and right-hand external zones and the central zone of the pressure roller.

The present invention achieves the advantage that, by varying the outer profile of the metallic roller core of the pressure roller, the coating of which has a substantially cylindrical outer configuration, the speed of passage of the copy material in the fusing roller gap is varied over the length of the roller. This process speed varies in accordance with the differences in the layer thickness of the silicone elastomer coating and the differences in the thickness of the roller core. As a result, copy materials with different passage behaviors in the fusing process, as, for example, opaque papers, transparent papers and films, can be processed equally well, without giving rise to wrinkling of any kind, even in the case of large-size DIN A1 copies. Equally good quality of toner image fusion on the copy materials results, even though opaque paper and transparent paper exhibit different passage behaviors, when they are conveyed through a roll-fusing apparatus including a pressure roller having a cylindrical roller core and a cylindrical silicone elastomer coating.

The invention is explained in greater detail below, with reference to an illustrative embodiment shown in the accompanying drawings.

A fusing apparatus 1 shown in FIG. 1 comprises a heated roller 10 and a pressure roller 2. The upper heated roller or fusing roller 10 is supported in bearings 5 and 6, for example ball bearings, and the lower pressure roller 2 is supported in bearings 23 and 24, wherein the bearings, in each case, are arranged in the interior of the rollers and the rollers are internally supported at a distance of about 20 mm from the respective end faces of the rollers.

The upper heated roller 10 has a length of about 670 mm and usually comprises an aluminum tube which has a wall thickness of from about 5 to 10 mm and a silicone elastomer coating which has a thickness of from about 1 to 1.2 mm. The silicone elastomer coating ends at a distance of from about 30 to 32 mm from the end faces 17 and 18 of the heated roller 10.

The pressure roller 2 comprises an aluminum tube which has a wall thickness of from about 5 to 7 mm and is covered with a coating comprising a silicone elastomer and a tubing formed of a shrink film. The maximum thickness of the silicone elastomer coating together with the tubing should not exceed about 5 mm. This coating extends from end face to end face of the pressure roller.

The pressure roller 2 interacts with the heated roller 10 to seize the copy material and convey it through the gap between the two rollers.

The shaft section jutting out from the end face 17 of the roller 10 supports a clutch 3 equipped with a gear wheel 26 which is driven by a cogged V-belt 4 or a roller chain.

Near the surface of the heated roller 10 and opposite to the center of the roller, a temperature sensor 19 is arranged, for example, a thermistor or a thermocouple, the two connecting wires of which are linked up with a control means 21. This control means controls the flow of the copying program, and is diagrammatically indicated in FIG. 1. Another temperature sensor 20, for example, a thermistor or a thermocouple, is provided near the surface and in the vicinity of the end face 17 of the heated roller 10 and is also connected to the control means 21 by its two connecting wires. The two temperature sensors ensure that the energy supply to heating elements positioned in the interior of the heated roller 10 is interrupted, when predetermined temperatures have been reached at the measuring points. Connecting wires 7 and 8 and 7' and 8' are run out of the interior of the heated roller 10 to the control means 21, which comprises a control circuit for actuating relays which disconnect the heating elements from the power supply when predetermined nominal values of temperature have been reached.

When fusing apparatuses of the prior art are adjusted such that the temperature over the length of the fusing roller and the contact pressure between the fusing roller and the pressure roller are as uniform as possible, an undesirable formation of wrinkles generally occurs in the middle of the copy. Close investigations have revealed that this wrinkling is related to transverse shrinkage of the copy material, produced by the fusing heat. As a result, the speed of passage in the roller gap is higher in the middle of the roller arrangement than at the edges thereof. The external zones of the copy material are then pushed together toward the middle, and a longitudinal buckle is formed, which is squeezed together to give a wrinkle as the material passes through the roller gap. Wrinkling occurs predominantly in the central area of the second half of a DIN A1 or DIN A2 copy on transparent paper.

Another problem encountered with conventional fusing apparatuses which are intended for use in the production of large-size copies, results from a double print duplication of the copy image, in which a second image is displaced by only a few tenths of a millimeter with respect to the first image. This phenomenon, also called "smearing effect" appears in the second half of a DIN A1 or DIN A2 copy, usually in the case of copies on opaque paper. The smearing effect can possibly be explained by the fact that a so-called "bow-wave" is formed, whch extends from edge to edge in the middle of the copy material as it passes through the apparatus. The toner image which is present on the "bow-wave" prematurely contacts the heated roller and, as a result, a so-called "cold-offset effect" occurs and gives rise to the second image which is displaced with respect to the first image.

The above-described phenomena are caused by differences in the speed of passage between the middle and the edges of the copy materials in the fusing roller gap. This speed differential is to be ascribed, on the one hand, to elastic deformations of the rollers and their coatings and, on the other hand, to different degrees of transverse shrinkage of the copy material. In the case of high transverse shrinkage, the external zones of the copy material are pushed in the direction of the middle of the copy materal, and thus a longitudinal buckle forms in the middle of the copy material, which leads to undesirable wrinkling, as explained above. To obviate wrinkling, it is necessary to increase the speed of passage in the area between the edges and the middle of the roller, in order to counteract pushing-together of the copy material in the direction of the middle. This is achieved by the configuration of the pressure roller 2, as explained below, with reference to FIG. 2.

Figure 2:
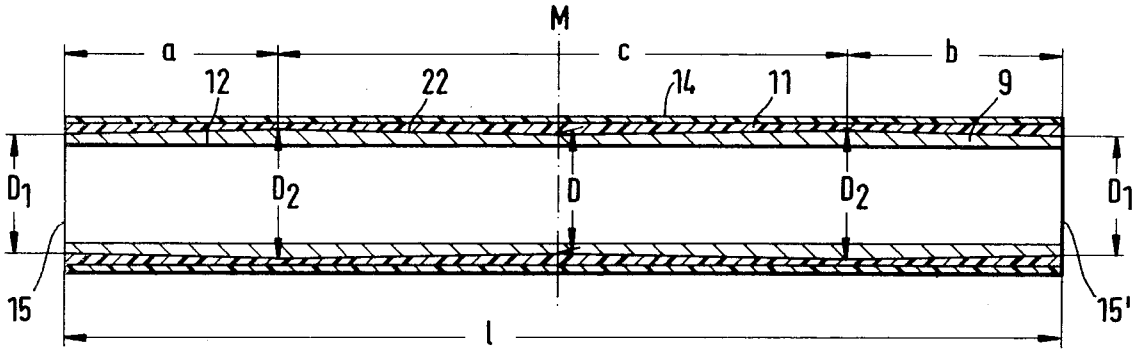
FIG. 2 is a sectional view of the pressure roller of the fusing apparatus according to FIG. 1.

The embodiment of the pressure roller 2 which is shown in a sectional view in FIG. 2, preferably comprises an aluminum roller core 9, which is provided on its outside with a coating 11 comprising a silicone elastomer. The roller core 9 has a non-cylindrical outer configuration and is divided into at least three zones over its length l, which are symmetrically arranged with respect to the middle M of the roller. The outside diameter D of the roller core in the middle M of the roller corresponds to the outside diameters $D_1$ and $D_1$ of the end faces 15 and 15' of the roller core.

In one illustrative example, the length of roller 1 is 636 mm, the outside diameter D in the middle M of the roller is 72.5 mm, the outside diameters $D_1$ and $D_1$ of the end faces are also 72.5 mm, and the outside diameters $D_2$ and $D_2$ which are located between the middle M of the roller and the end faces are 74 mm. Each of the external zones a and b has a length of 142 mm and the central zone c has a length of 352 mm. The outside diameters $D_1$ and $D_1$ of the end faces and the outside diameters $D_2$ and $D_2$ can also have different values with respect to the diameter D in the middle of the roller. Similarly, the lengths a and b of the external zones and the length c of the central zone can be varied within certain limits. In an example of an embodiment of this kind, in which the length of roller 1 is also 636 mm, the outside diameter D in the middle M of the roller is 72 mm, the outside diameters $D_1$ and $D_1$ of the end faces are 70 mm, and the outside diameters $D_2$ and $D_2$ which are located between the middle M of the roller and the end faces are 74 mm. The external zones a and b each have a length of 168 mm, and the central zone c has a length of 300 mm.

The roller core 9 which has the form of a hollow tube, comprises a cylindrical inner surface 12 and an outer surface 22 which is extended to give a saw-toothed, repeatedly bent configuration. More particularly, the outer surface exhibits radial symmetry and comprises alternating regions of greater and lesser circumference.

A silicone elastomer coating 11 is disposed on the roller core 9, which has a cylindrical outer configuration and an inner configuration which is adapted to the outlines of the outer surface 22 of the roller core 9. The coating is firmly bonded to the outside of the roller core 9, and thus a cylindrical outer configuration of the pressure roller is maintained.

A film tubing 14 of substantially constant thickness, preferably comprising a perfluoroethylene/propylene copolymer, is appropriately shrunk onto the coating 11.

Compared with pressure rollers having cylindrical roller cores, profiling of the roller core in accordance with the present invention results in a nearly complete coincidence of the temperature/pressure characteristics in the roller gap of the roller-pair arrangement, required for the different copy materials, such as opaque papers, transparent papers and films. Pressure rollers with cylindrical roller cores merely have temperature/contact pressure characteristics to prevent wrinkling in transparent papers or to prevent duplicating in opaque papers, and these characteristics either do not coincide at all or coincide to an insufficient degree.

Profile-turning of the roller core 9 to produce the corresponding outlines of the outer surface 22 involves only very low additional cost, compared to the production of a cylindrical roller core. It is also an advantage that the pressure roller has a cylindrical outer configuration and can thus easily be machined.

Figure 3:
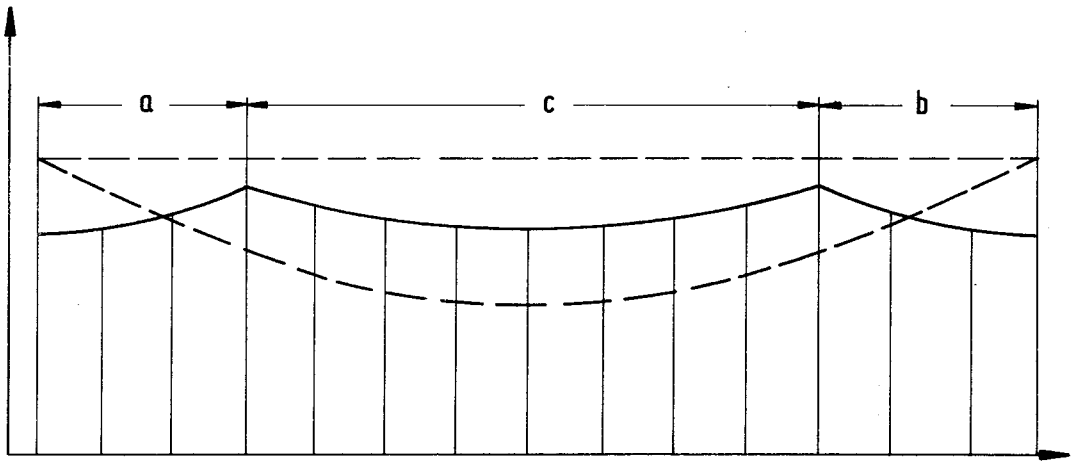
FIG. 3 is a diagram of the passage speed profile through the roller gap of the fusing apparatus according to FIG. 1.

FIG. 3 shows a diagrammatic representation of the passage speed profile of the copy material in the roller gap over the length of roller 1. As is seen, the areas of the highest passage speed, i.e., of the highest propulsion in the roller gap, are not located at the edges or end faces, respectively, of the roller, but are shifted in the direction of the middle M of the roller. This passage speed profile shows a certain analogy to the bending-moment characteristic of a beam resting on two supports and having identical deflections in the middle and at the two ends. Accordingly, a minimum passage speed occurs in each case in the two external zones and in the middle of the roller, and maxima occur at the boundary surfaces between the left-hand and right-hand external zones and the central zone c of the pressure roller 2. The passage speed profile of the copy material obtained with a cylindrical roller core, which shows a single minimum in the middle of the roller, is indicated by an interrupted line in FIG. 3. This is compared to the passage speed profile of the roller core 9 according to the present invention, which is divided into three relatively small zones. Each of these zones has a minimum which, incidentally, has a lower absolute value than the minimum which is obtained when a cylindrical roller core is used.

As a result of profiling of the roller core 9, the speed of passage in the vicinity of the roller edges or in the external zones a and b, respectively, compared with the speed of passage in the middle M of the roller, is rendered sufficiently high to enable wrinkle-free fusion of toner images on transparent paper. On the other hand, the so-called "bow-wave" which is formed in opaque paper decreases in length and height to such an extent that it can no longer have a disturbing effect, and duplicating of the copy image is thus prevented.

What is claimed is:

1. A roll-fusing apparatus, comprising:

an internally heated fusing roller; and a pressure roller positioned adjacent to said fusing roller for fusing a toner image on a copy support which is conveyed between said rollers, said pressure roller comprising a coated hollow roller core supported on a shaft, wherein the roller core comprises a substantially cylindrical inner surface and a radially symmetrical outer surface comprising alternating regions of greater and lesser circumference.

2. A roll-fusing apparatus as claimed in claim 1, wherein the roller core is divided into at least three zones over the length of the roller, which are symmetrically arranged with respect to the middle of the roller.

3. A roll-fusing apparatus as claimed in claim 2, wherein a middle zone is axially symmetrical about the midpoint of the roller; one end of each external zone borders the middle zone at a relative maximum diameter of the roller core; and the other end of the external zones is defined by the end faces of the roller.

4. A roll-fusing apparatus as claimed in claim 3, wherein the outside diameter of the roller core in the middle of the roller corresponds to the outside diameters of the end faces of the roller core; and the maximum outside diameters of the core, which are located between the middle zones of the roller and the end faces, are up to about 2 mm greater than the outside diameter in the middle zone of the roller.

5. A roll-fusing apparatus as claimed in claim 1, wherein the roller core coating comprises a cylindrical outer configuration and is firmly bonded to the outside of the roller core.

6. A roll-fusing apparatus as claimed in claim 5, wherein the pressure roller coating comprises a silicone elastomer.

7. A roll-fusing apparatus as claimed in claim 3, wherein a speed of passage profile, indicating at least two passage rates, is generated in the roller gap over the length of the rollers, wherein a minimum appears in the two external zones and in the middle zone of the roller, and a maximum appears in each of the boundary surfaces between the two external zones and the central zone of the pressure roller.

8. A roll-fusing apparatus as claimed in claim 3, wherein the outside diameter of the roller core in the middle zone of the roller is greater than the outside diameter of the end faces of the roller core; and the maximum outside diameters of the roller core, which are located between the middle zone of the roller and the end faces, are up to about 4 mm greater than the diameters of the end faces and up to about 2 mm greater than the diameter in the middle zone of the roller.

9. A roll-fusing apparatus as claimed in claim 4, wherein the length of the roller is about 636 mm and the lengths of the external zones are the same, and are between about 142 mm and 168 mm.

10. A roll-fusing apparatus as claimed in claim 8, wherein the length of the roller is about 636 mm and the length of the external zones are the same, and are between about 142 mm and 168 mm.

11. A roll-fusing apparatus as claimed in claim 1, further comprising a film tubing having a constant thickness shrunk onto the outside of the pressure roller coating.

12. A roll-fusing apparatus as claimed in claim 4, wherein the length of the roller is about 636 mm; the outside diameter in the middle of the roller and at the two end faces of the roller is about 72.5 mm; and the maximum diameter in each of the two external zones is about 74 mm.

13. A roll-fusing apparatus as claimed in claim 12, wherein the length of each of the two external zones is about 142 mm, and the length of the middle zone is about 352 mm.

14. A roll-fusing apparatus as claimed in claim 7, wherein the length of the roller is about 636 mm; the outside diameter in the middle of the roller is about 72 mm; the diameters of the end faces are about 70 mm; the maximum outside diameters in the external zones is about 74 mm; the external zones each have a length of about 168 mm; and the middle zone has a length of about 300 mm.

15. A roll-fusing apparatus as claimed in claim 11, wherein the film tubing comprises a perfluoroethylene/propylene copolymer.

16. A roll-fusing apparatus as claimed in claim 1, wherein the pressure roller comprises an aluminum tube having a wall thickness of from about 5 to 7 mm.

17. A roll-fusing apparatus as claimed in claim 6, wherein the pressure roller coating extends substantially over the entire length of the roller.

18. A roll-fusing apparatus as claimed in claim 1, further comprising means for interrupting the energy supply to the heating elements of the internally heated fusing roller when the heating roller reaches a predetermined temperature.

* * * * *